US009287024B2

(12) United States Patent
Pelletier

(10) Patent No.: US 9,287,024 B2
(45) Date of Patent: Mar. 15, 2016

(54) BUCKET STEP INSERT

(71) Applicant: Plastic Techniques, Inc., Goffstown, NH (US)

(72) Inventor: Marcel Pelletier, Francestown, NH (US)

(73) Assignee: Plastic Techiques, Inc., Goffstown, NH (US)

( * ) Notice: Subject to any disclaimer, the term of this patent is extended or adjusted under 35 U.S.C. 154(b) by 0 days.

(21) Appl. No.: 14/211,808

(22) Filed: Mar. 14, 2014

(65) Prior Publication Data

US 2014/0305681 A1 Oct. 16, 2014

Related U.S. Application Data

(60) Provisional application No. 61/781,930, filed on Mar. 14, 2013.

(51) Int. Cl.
*H01B 17/56* (2006.01)
*B66F 11/04* (2006.01)

(52) U.S. Cl.
CPC ..... *H01B 17/56* (2013.01); *B66F 11/04* (2013.01)

(58) Field of Classification Search
CPC ..... H01B 17/56; B66F 11/04; B66F 11/044; H02G 3/08; H02G 3/081
USPC ..... 174/138 R, 135, 137 R, 138 G, 50; 182/3, 182/2.1, 46, 47, 150, 228.2, 2.4
See application file for complete search history.

(56) References Cited

U.S. PATENT DOCUMENTS

| | | | | |
|---|---|---|---|---|
| 3,404,751 | A * | 10/1968 | Nosworthy | 182/46 |
| 3,625,305 | A | 12/1971 | Mueller et al. | |
| 3,642,096 | A | 2/1972 | Valentine | |
| D235,474 | S | 6/1975 | Kachavos | |
| 3,917,026 | A | 11/1975 | Hedges | |
| 4,605,098 | A | 8/1986 | Leuty | |
| 4,763,758 | A | 8/1988 | Moody | |
| 4,883,145 | A | 11/1989 | Deltatto | |
| 6,470,999 | B1 | 10/2002 | Schanzle | |
| 8,899,380 | B2 * | 12/2014 | Chard | 182/2.1 |
| 2006/0226667 | A1 | 10/2006 | Leaverton | |

FOREIGN PATENT DOCUMENTS

| | | | |
|---|---|---|---|
| CN | 202671164 | U | 1/2013 |
| JP | 06080373 | A | 3/1994 |
| JP | 2010058874 | A | 3/2010 |

OTHER PUBLICATIONS

Bain, "Ergonomic Design of an Aerial Bucket for Ingress and Egress", "Master's Theses (2009-)", 2009, Publisher: Marquette University, Published in: US.

* cited by examiner

*Primary Examiner* — Angel R Estrada
(74) *Attorney, Agent, or Firm* — Loginov & Associates, PLLC; William A. Loginov

(57) ABSTRACT

The invention provides an aerial lift bucket insert having a raised step. The bucket insert is comprised of a pan, the pan having a raised rim wall that includes a handle and a raised step. The raised step has an area beneath the raised step that is sufficient to accommodate a worker's boot. The bottom of the pan and the top of the step are provided with scuff pads. In other embodiments, there can be a plurality of raised steps one atop the other or in opposing corners. The raised formed step is 9 inches high, has a depth of 5.5 inches and the distance between the bottom of the raised formed step and the pan is 5 inches. A cutout handle in the wall facilitates cleaning of the insert.

5 Claims, 2 Drawing Sheets

BUCKET STEP INSERT

RELATED APPLICATIONS

This application claims the benefit of U.S. Provisional Application Ser. No. 61/781,930, filed Mar. 14, 2013, entitled BUCKET STEP INSERT, the entire disclosure of which is herein incorporated by reference.

FIELD OF THE INVENTION

This invention relates to the field of aerial lift buckets and more specifically, to bucket inserts for aerial lift buckets.

BACKGROUND OF THE INVENTION

Aerial lift buckets, sometimes referred to in the art as aerial lift baskets, facilitate an electrical worker's performance at elevated heights. Aerial lift buckets are useful in operations that include maintenance, construction and repair of overhead lines, as well as in the clearance of trees and other objects from the vicinity of overhead lines. In the course of such operations, workers are in constant threat of injury by electrocution, as well as falling out of a raised lift bucket.

Aerial lift buckets are constructed of non-conductive matter (for example, fiberglass) to prevent unexpected transmission of electrical current. The exterior of a lift bucket tends to be a rigid structure made of fiberglass or fiberglass-reinforced plastic for insulation and for structural rigidity and wear. As a secondary protection, aerial lift buckets are provided with a removable liner constructed of a non-conductive material, such as polyethylene, that can be removed for cleaning and testing of its non-conductivity. While it is possible to test a lift bucket itself, lift buckets are generally stored attached to the lifting apparatus atop the truck and disassembly is required. It is simpler to remove the bucket insert. Replacement of a worn or damaged insert is also less expensive than replacing the lift bucket.

Workers operating in a lift bucket tend to wear heavy boots upon their feet and spend a great deal of time standing while reaching out beyond the bucket to work. Lift bucket sizes and shapes vary, but all have in common a depth that is such that a worker of average height will stand in the lift bucket up to their waist, or slightly above. This depth makes exiting from the bucket more difficult. Heavy clothing can make movement in and out of a bucket more cumbersome. Another factor is that the liner is formed of a smooth plastic, which provides no gripping surfaces to facilitate climbing out. Given that the job of lineman is dangerous, the numbers of young men entering the work force is diminishing and as a result, the work force is aging. An older work force is more prone to fatigue and orthopedic injury, and has a harder time climbing out of the lift bucket, especially after working on overhead lines. A scuff pad is a surface treatment that can include a layer of applied grit or raised and/or inscribed features that adds a texture to the floor of the liner and increases the footing of the lineman, increasing their safety and reducing accidental injury.

To ease the burden of the worker in getting out of the bucket, a variety of aerial lift bucket and bucket insert steps have been developed. An effective bucket insert step is taught in U.S. Pat. No. 4,763,758, entitled SCUFF PAD WITH STEP by Richard D. Moody, the teachings of which are incorporated herein by reference as useful background information. While the step is an advantage over the prior art, it is formed in a corner and diminishes the available space for the worker's feet. If the worker is required to reach out over the corner where the step is located, the step gets in the way and the worker is forced to extend further, increasing strain to the body, raising the risk of falling from the lifted bucket and reducing the worker's efficiency.

It is desirable to improve on the step to remove the obstruction of the base of the step and provide the worker to use the entire liner base for foot placement. This in turn provides the worker full use of the step corner and provides normal arm reach without further extension of the back or related body structures.

SUMMARY OF THE INVENTION

This invention overcomes disadvantages of the prior art by providing a aerial lift bucket insert having an internal step that is formed so that there is space under the step for placement of a worker's foot. In an illustrative embodiment, a liner for an aerial lift bucket is comprised of a flat pan that forms the bottom of the liner. The pan has a wall that includes a raised portion. Raised portion has a handle and encompasses a corner of the pan. The corner of the raised portion is provided with a raised step that has space beneath it sufficient to accommodate a worker's booted foot so as to allow use of the full floor footprint of the bucket insert. The pan has at least one scuff pad and the step has a scuff pad. In other embodiments, the liner can be provided with more than one raised step above the other or counter-posed on another corner of the rim. The cutout handle enables removal of the liner from the aerial lift bucket for cleaning and removal of debris from the aerial lift bucket. In an embodiment, the raised formed step has a depth of 5.5 inches, a height of 9 inches and a distance between the bottom of the step and the pan is 5 inches.

BRIEF DESCRIPTION OF THE DRAWINGS

The invention description below refers to the accompanying drawings, of which.

DETAILED DESCRIPTION

Figure 1:
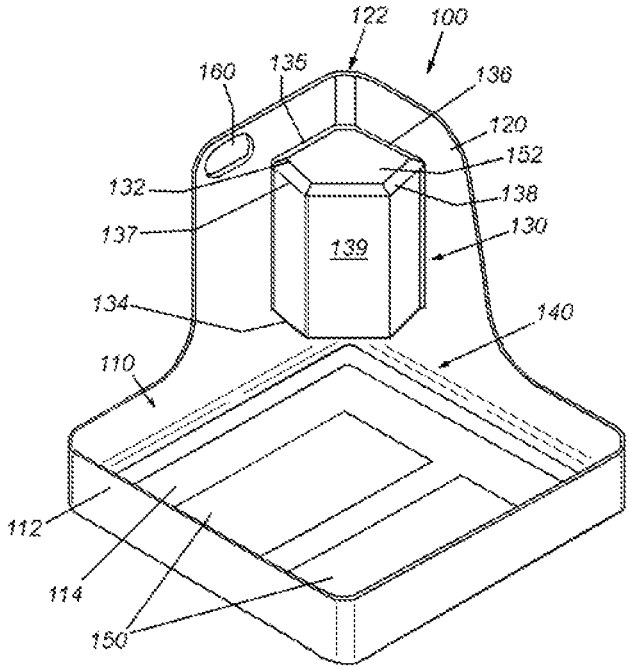
FIG. 1 is a perspective view of a bucket insert with a raised step according to an illustrative embodiment.

An illustrative bucket insert 100 with a raised step 130 is depicted in FIG. 1 in an embodiment. The liner 100 is removable for conductivity testing, cleaning, inspection and/or repair. The liner 100 is formed of a copolymer by molding and is provided with a pan 110, a raised rim 120 with a raised step 130 and a handle 160. The inside surface 114 of the pan is provided with one or more scuff (non-slip) pads 150 that promote a secure footing for the worker while standing in the bucket insert 100. The floor footprint of the pan is defined as the full surface area of the pan 110 within the perimeter of the rim. The scuff pads 150 help to give the worker traction when working within the bucket insert and encourage a secure footing that contributes to worker safety. The scuff pads are secured to the liner by adhesives that are thermally applied or non-thermally applied. The pan 110 is of a generally rectangular shape and conforms to the interior of the lift bucket.

A raised step 130 is co-molded into raised rim 120. The step has a flat top 132 and a flat bottom 134. In other embodiments, the bottom can be non-flat. The shape of the raised step 130 defines an irregular pentagon in an illustrative embodiment, having two long sides 135, 136 along the raised rim 120; two short sides 137, 138 and an inner face 139. In other embodiments, the step can describe a semi-circular shape, a triangular shape or another shape. Notably, the geometry of the liner, 100 is arranged so that rim 120, step 130 and handle 160 are all part of a unitary molded structure, thereby increasing durability and reducing component-count and production costs. The material used for the liner is highly variable. For example, ABS, PET, polycarbonate, acrylic or PVC plastic (or combinations thereof) can be employed. Likewise composites, such as glass-filled nylon, fiberglass, epoxy-glass, and the like can be laid up and molded to form a unitary structure. The use of appropriate materials should be clear to those of skill.

The step 130 has a raised bottom 134 and the space below the step 130 is unobstructed to the corner 122 of the raised rim. This open space, also known as a toe space, provides for the front part of a worker's boot to be placed there without obstruction foot so as to allow use of the full floor footprint of the bucket insert. The raised step with an open space below facilitates full use of the liner without obstruction, while providing the helpful benefits of a step to aid in entry and egress of the liner.

Figure 2:
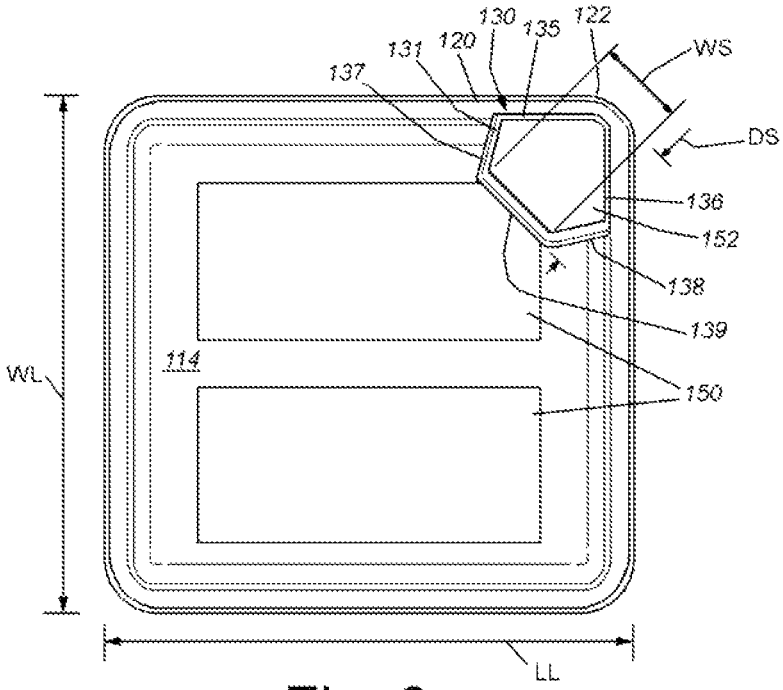
FIG. 2 is a top view of a bucket insert with a raised step according to the illustrative embodiment.

FIG. 2 is a top view of the aerial bucket insert 100 according to an illustrative embodiment. The illustrative liner 100 has a width WL of approximately 20 inches (50 cm) and a length LL of approximately 20 inches (50 cm). It is expressly contemplated that the width WL can be as small as or smaller than 18 inches and as great as or greater than 60 inches (150 cm), and the length LL can be as small as or smaller than 18 inches and as great as or greater than 60 inches, depending on the size of the aerial bucket and the bucket insert. The size can also vary based on whether the liner is constructed and arranged to accommodate one or more than one worker. The step has a width WS of approximately 4.5 inches (11.4 cm) and a depth of approximately 5.5 inches (14 cm). The depth is defined as the distance between the inner face 139 and the corner 122.

Figure 3:
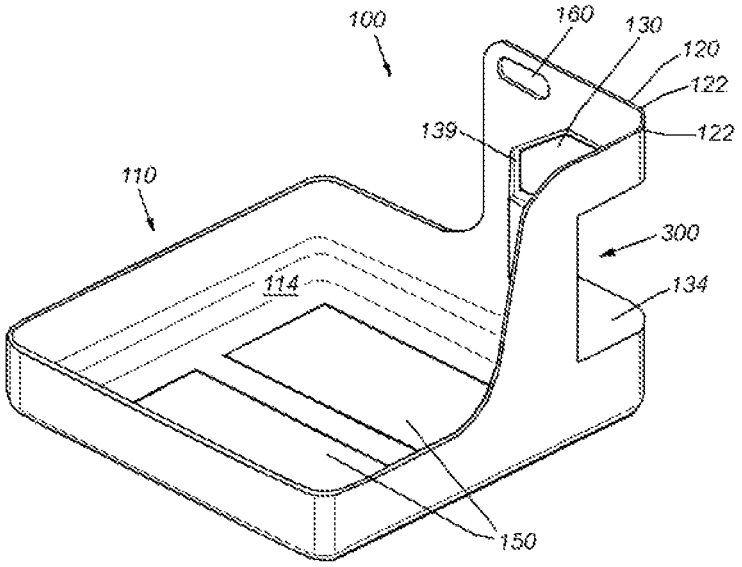
FIG. 3 is a perspective view of a bucket insert with a raised step according to the illustrative embodiment.

FIG. 3 is a perspective view of the liner 100, showing the geometry of the raised step 130. The step 130 can be created during molding by a punch 300 that forms the step 130. The position and size of the handle 160 can vary. The number and orientation of the scuff panels 150 can vary. For example, the scuff pads 150 can be a single pad. The illustrative pads 150, 152 are attached to the pan 110 and the step 130 by adhesives in a thermal or non-thermal process. The thickness of approximately ⅛th of an inch (3 mm). It is expressly contemplated that the material thickness can vary based on the materials used and the overall size of the liner.

The handle 160 can be utilized to remove the liner 100 from the aerial bucket for cleaning The position of the handle enables the user to raise and remove the liner without spilling any entrapped debris without dropping the debris back into the aerial bucket. The cutout handle 160 therefore enables removal of the liner from the aerial lift bucket for cleaning and removal of debris. This is a convenient and labor-saving feature, in particular, when the aerial bucket is being used for clearing foliage away from the site of the work and debris can accumulate in the floor of the bucket insert.

Figure 4:
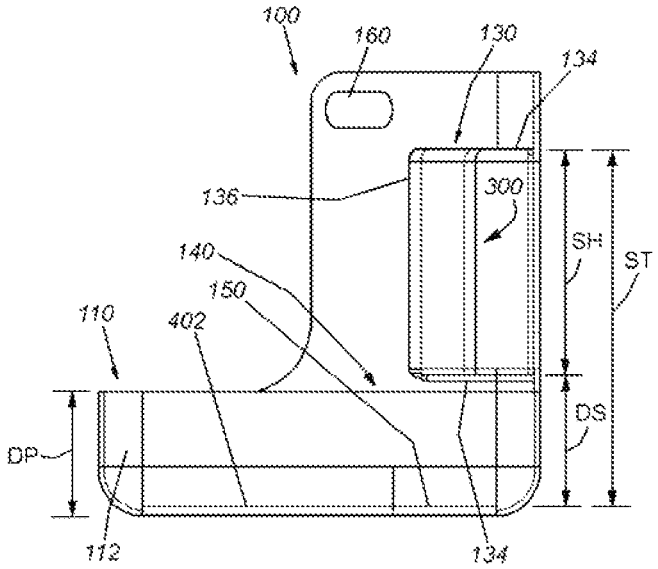
FIG. 4 is a side view of a bucket insert with a raised step according to the illustrative embodiment.

FIG. 4 is a side view of the liner showing the geometry of the raised step 130, the punch 300, the pan 110 and the area 140 under the step 130. The depth of the pan DP is approximately 4¾ inches (12 cm). This can vary higher or lower based on the overall size of the pan, materials used and the number and weight of the users. In an illustrative embodiment, the distance DS is defined as the distance between the surface of the bottom 134 of the raised step 130 and the upper surface 402 of the scuff pads 150 attached to the pan 110*d* is approximately 5 inches (12.7 cm). This distance can vary with the vertical location of the step 130, the height of the step and the thickness of the non-slip materials used in the scuff pads 150. The height of the step SH is approximately 9 inches (23 cm) from the bottom 134 of the step to the top 132 of the step. The height of the top of the step ST from the bottom of the pan is approximately 14 inches 35.6 cm). This height can vary greater or lesser based on the position of the step and the geometry of the step. The step 130 is raised such that the area 140 underneath the step is of sufficient clearance that a worker can move their boot in that place without interference. As noted above, this freedom of movement reduces the safety risks to the worker. The clear area 140 provides for a more upright posture for the worker, which in turn leads to less fatigue and back strain, and less chance of an orthopedic injury. The step 130 facilitates entry and egress of the liner with a further reduction in strain on the worker.

It should be clear that the illustrative bucket insert provides an effective step while retaining full use of the floor footprint of the bucket insert. Thus, the liner enhances both safety and utility for workers.

The foregoing has been a detailed description of illustrative embodiments of the invention. Various modifications and additions can be made without departing from the spirit and scope of this invention. Features of each of the various embodiments described above can be combined with features of other described embodiments as appropriate in order to provide a multiplicity of feature combinations in associated new embodiments. Furthermore, while the foregoing describes a number of separate embodiments of the apparatus and method of the present invention, what has been described herein is merely illustrative of the application of the principles of the present invention. For example, more than one raised step can be provided in a liner, for example, in a two-worker liner, there can be one step for each worker in the respective corners, counterpoised. It is further contemplated that more than one step can be stacked one above the other in the same corner so as to create a multi-step entry and egress. The shape profile of the step can be a rectangle, pentagon, triangle, semi-circular or another shape. The height and width of the step can vary. The height of the area beneath the step can vary. The scuff pads can be co-molded with the liner. Accordingly, this description is meant to be taken only by way of example, and not to otherwise limit the scope of this invention.

What is claimed is:

1. A liner for an aerial lift bucket comprising:

a flat pan that is the bottom of the liner, the pan being provided with at least one scuff pad and surrounded by a rim wall;

a raised portion of the rim wall having a cutout handle and defined by a corner;

a formed raised step that is molded of the corner of the raised rim wall; and a space under the formed raised step for the placement of a booted foot on the pan or on a floor of the aerial lift bucket.

2. The liner for an aerial lift bucket of claim 1 wherein the cutout handle enables removal of the liner from the aerial lift bucket for cleaning and removal of debris.

3. The liner for an aerial lift bucket of claim 1 wherein a depth of the formed raised step is at least approximately 5.5 inches.

4. The liner for an aerial lift bucket of claim 1 wherein a distance between the bottom surface of the formed raised step and the top surface of the scuff pad attached to the pan is at least approximately 5 inches.

5. The liner for an aerial lift bucket of claim 1 wherein a height of the formed raised step is at least 9 inches from a bottom surface of the step to a top surface of the step.

* * * * *